US007621023B2

(12) United States Patent
Pyatt

(10) Patent No.: US 7,621,023 B2
(45) Date of Patent: Nov. 24, 2009

(54) ADJUSTABLE TOOL HANDLE

(75) Inventor: Georgia A. Pyatt, Fayetteville, AR (US)

(73) Assignee: Marshalltown Company, Marshalltown, IA (US)

( * ) Notice: Subject to any disclaimer, the term of this patent is extended or adjusted under 35 U.S.C. 154(b) by 53 days.

(21) Appl. No.: 11/949,945

(22) Filed: Dec. 4, 2007

(65) Prior Publication Data

US 2009/0139380 A1 Jun. 4, 2009

(51) Int. Cl.
*B25G 1/10* (2006.01)

(52) U.S. Cl. ..... 16/430; 16/436; 81/489; 15/144.1

(58) Field of Classification Search ..... 16/436, 16/441, 422, 430, 110.1, 431, DIG. 30; 74/543, 74/553; 15/144.1; 81/177.1, 177.8, 177.9, 81/489
See application file for complete search history.

(56) References Cited

U.S. PATENT DOCUMENTS

| | | | | |
|---|---|---|---|---|
| 1,296,416 | A | 3/1919 | Maddox | |
| 2,068,207 | A | 1/1937 | Torbert | |
| 2,576,751 | A | 11/1951 | Dortmund | |
| 3,070,370 | A | 12/1962 | Steiner | |
| 3,665,785 | A | 5/1972 | Moal | |
| 3,915,021 | A | 10/1975 | Schwartz et al. | |
| 3,968,965 | A | 7/1976 | Frenkel et al. | |
| 4,035,089 | A | 7/1977 | Schwartz et al. | |
| 4,043,220 | A | 8/1977 | Kolb | |
| 4,466,309 | A | 8/1984 | Matey | |
| 4,709,602 | A * | 12/1987 | Grabovac et al. | 81/483 |
| 4,805,494 | A | 2/1989 | Santoro | |
| 4,958,407 | A | 9/1990 | Johnson | |
| 4,976,173 | A | 12/1990 | Yang | |
| 5,161,293 | A | 11/1992 | Ebbert | |
| 5,263,275 | A | 11/1993 | Rumbaugh | |
| 5,269,045 | A | 12/1993 | DeSerio et al. | |
| 5,280,738 | A | 1/1994 | Liou | |
| 5,329,834 | A | 7/1994 | Wong | |
| 6,490,761 | B2 * | 12/2002 | Durrant | 16/436 |
| 6,640,674 | B1 * | 11/2003 | Rinner et al. | 81/475 |
| 2006/0048613 | A1 * | 3/2006 | Abel et al. | 81/177.2 |
| 2008/0148524 | A1 * | 6/2008 | Wiker et al. | 16/431 |

OTHER PUBLICATIONS

"Cross Morph Pen" by Cross Pen Company (as advertised on www.londonluggage.com), 2 pp.

* cited by examiner

*Primary Examiner*—William L. Miller
(74) *Attorney, Agent, or Firm*—Shook, Hardy & Bacon LLP

(57) ABSTRACT

An adjustable handle and method of adjusting the cross-sectional shape of a handle is disclosed. The handle comprises a central core having a plurality of axially extending grooves each having at least two radially extending ramps as well as a sleeve having a plurality of flexible expandable members with a plurality of fins in sliding relationship with the axially extending grooves and ramps. When a user turns a knob of the handle, the sleeve is directed to slide axially within the groove such that the fins of the flexible expandable members contact the ramps thereby altering the cross sectional shape of the handle over an axial distance.

20 Claims, 5 Drawing Sheets

ADJUSTABLE TOOL HANDLE

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND

The present invention relates generally to a hand tool device. In particular, the invention relates to an adjustable handle for a hand tool device.

Small hand tools such as trowels, screwdrivers, hammers, and other hand-held tools frequently are used when performing various types of construction and home-improvement projects. The handles of these tools typically are fabricated of relatively rigid wood or plastic and have a fixed diameter and cross-sectional shape. In order to produce these and other hand tools in large quantities, a standard-size handle is typically produced and affixed to the tool element. The cross-sectional shape and dimensions of the standard size handle is determined based upon an average hand size for a user as determined by the tool manufacturer. However, these tool handles do not take into account the various grip size and strength of the users. In addition, when the tools are used for extended periods of time, the tool's rigid, fixed-diameter handle can cause user fatigue and discomfort.

SUMMARY

In order to overcome the above-stated problems and limitations, and others, there is provided a handle for a hand tool or other hand-held device that is adjustable to better conform to a user's grip, hand size, and physical condition. The cross-section of the handle can readily be adjusted by the user.

In general, the adjustable handle of the present invention comprises a central core with an outer surface having a plurality of axially extending grooves, with each of the grooves comprising a plurality of radially extending ramps that extend outward to the outer surface. The first end of the central core has an opening for receiving a tool element and the outer surface on the core proximate its second end has a threaded region. The handle also comprises a knob that is engaged with the threaded region of the central core. Positioned about the central core is a sleeve having a first end and a plurality of slots extending axially to thereby form a plurality of flexible expander members, each of the expander members having a plurality of fins that are positioned in a sliding relationship with the axially extending grooves of the central core. A cover is positioned about the plurality of flexible expander members of the sleeve.

In a second embodiment of the present invention, a tool handle capable of adjusting to a user's grip is disclosed. A tool handle is adjustable in that the user can adjust a shape of the tool handle by turning the knob in a clockwise or counterclockwise direction so as to move the sleeve, and hence, plurality of flexible expander members axially such that the fins move along the radially extending ramps in a radial and axial direction. The movement of these fins in an axial and radial direction changes the cross sectional shape of the handle.

In a third embodiment of the present invention a method of adjusting the shape of a hand tool handle is disclosed. The shape of the tool handle having the components previously discussed can be adjusted by a user gripping the cover of the handle with a user's first hand. The knob is turned in a clockwise or counterclockwise direction by a user's second hand. The movement of the knob thereby causes the sleeve and plurality of flexible expander members to move axially such that the fins move along the radially extending ramps of the central core in both radial and axial directions to adjust the handle shape within the user's first hand. This process can be repeated in either direction until the user is satisfied with the shape of the handle within the user's grip.

Further objects, features, and advantages of the present invention over the prior art will become apparent from the detailed description of the drawings which follows, when considered with the attached figures.

BRIEF DESCRIPTION OF THE SEVERAL VIEWS OF THE DRAWINGS

Illustrative embodiments of the present invention are described in detail below with reference to the attached drawing figures, which are incorporated by reference herein and wherein.

DETAILED DESCRIPTION

Figure 1:
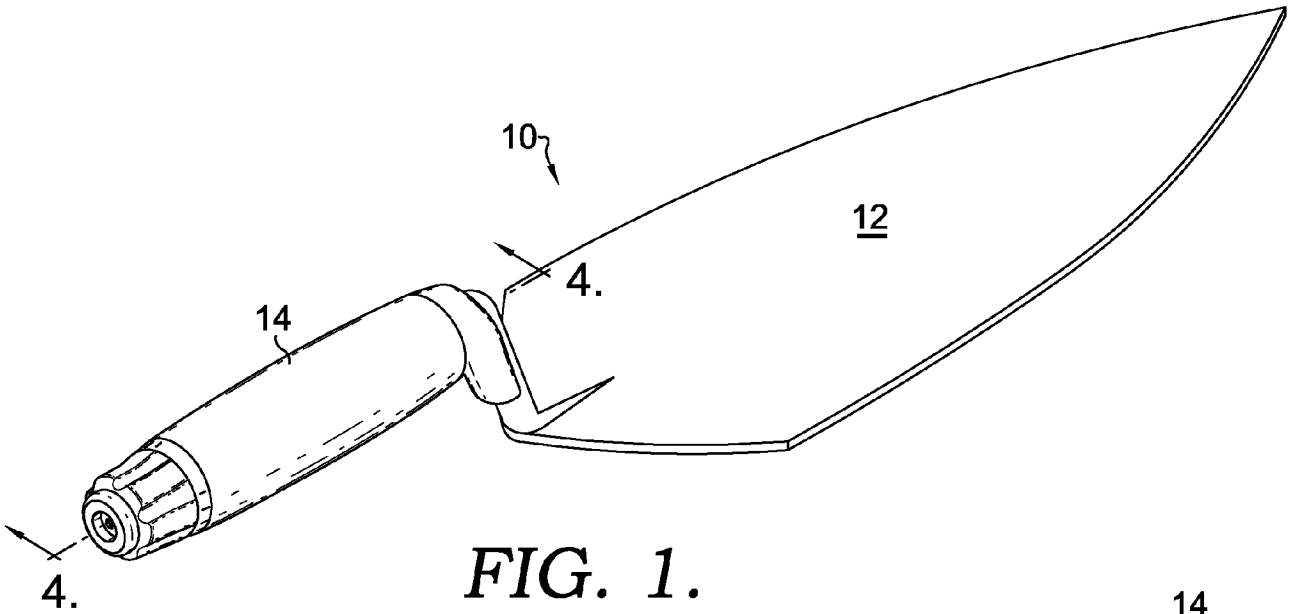
FIG. 1 is a perspective view of a hand tool in accordance with an embodiment of the present invention.
Figure 2:
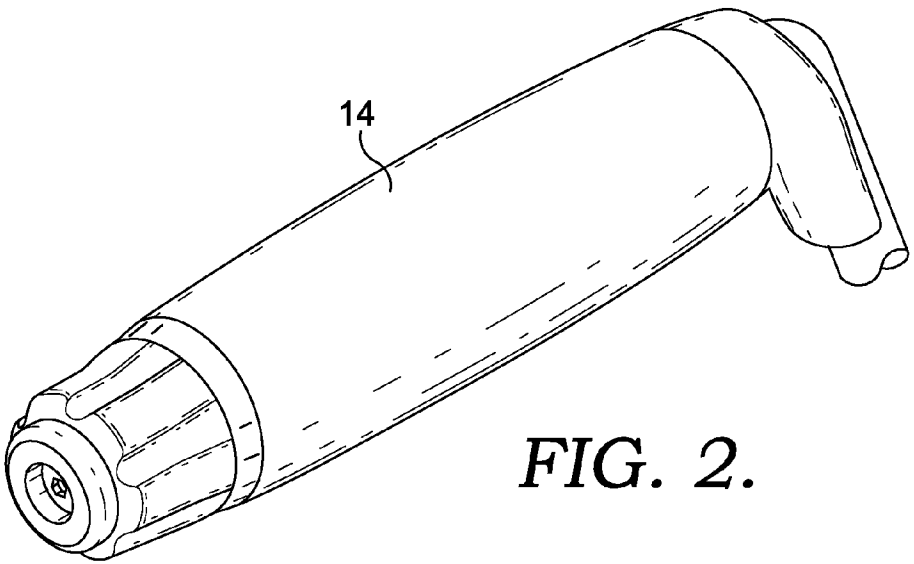
FIG. 2 is a perspective view of a handle portion of a hand tool in accordance with an embodiment of the present invention.
Figure 3:
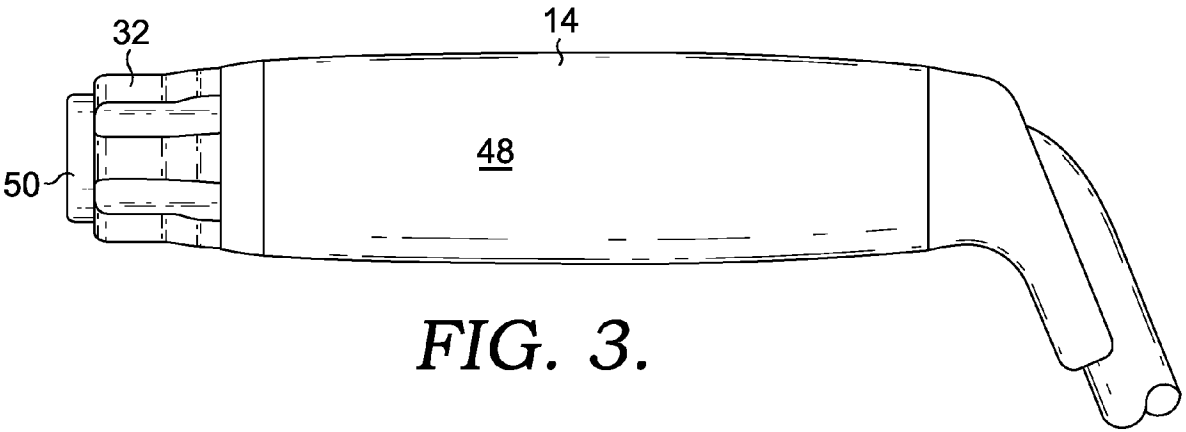
FIG. 3 is a side elevation view of a handle portion of a hand tool in accordance with an embodiment of the present invention.

Referring now to the drawings in detail, and initially to FIG. 1, a hand shovel 10 or trowel is shown in perspective view. The trowel 10 comprises a blade 12 and a handle 14. A detailed perspective view of the handle 14 is shown in FIG. 2 and a side elevation view of the handle 14 is shown in FIG. 3.

Referring now to FIGS. 4-9, the handle 14 comprises a generally axially extending central core 16 having a core first end 18, a core second end 20, and an outer surface 22. The outer surface 22 of the central core 16 has a plurality of axially extending grooves 24 located therein. The number of grooves can vary between embodiments. However, it is preferred that the plurality of axially extending grooves 24 comprises at least three grooves. In the embodiment shown in FIGS. 4-7, six grooves are utilized.

Located in each of the axially extending grooves 24 is a plurality of radially extending ramps 26. The ramps 26 extend radially outward to the outer surface 22. As it can be seen from FIG. 4, the plurality of radially extending ramps comprises two ramps in each of the axially extending grooves 24. However, a larger quantity of ramps can be utilized. Other features of the central core 16 comprise an opening 28 proximate the first end 18 for receiving a tool element, such as a trowel blade 12.

In an alternate embodiment of the present invention, the opening 28 in the core 16 can extend from the first end 18 to the second end 20 such that the core is essentially hollow. In this configuration the tool element can pass completely through the handle 14 and be attached to the handle 14 proximate the second end 20.

Figure 5:
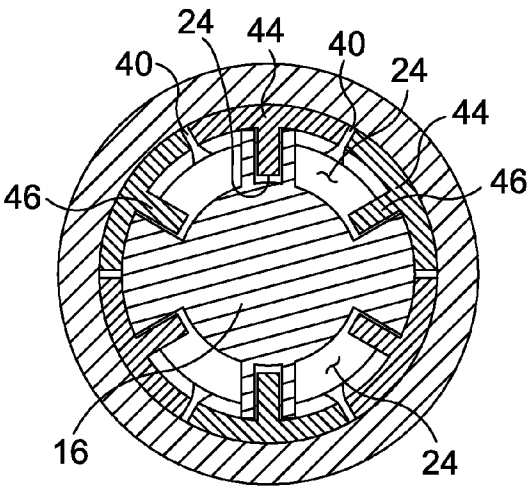
FIG. 5 is a cross section view taken through FIG. 4 of the handle portion of a hand tool in accordance with an embodiment of the present invention.
Figure 6:
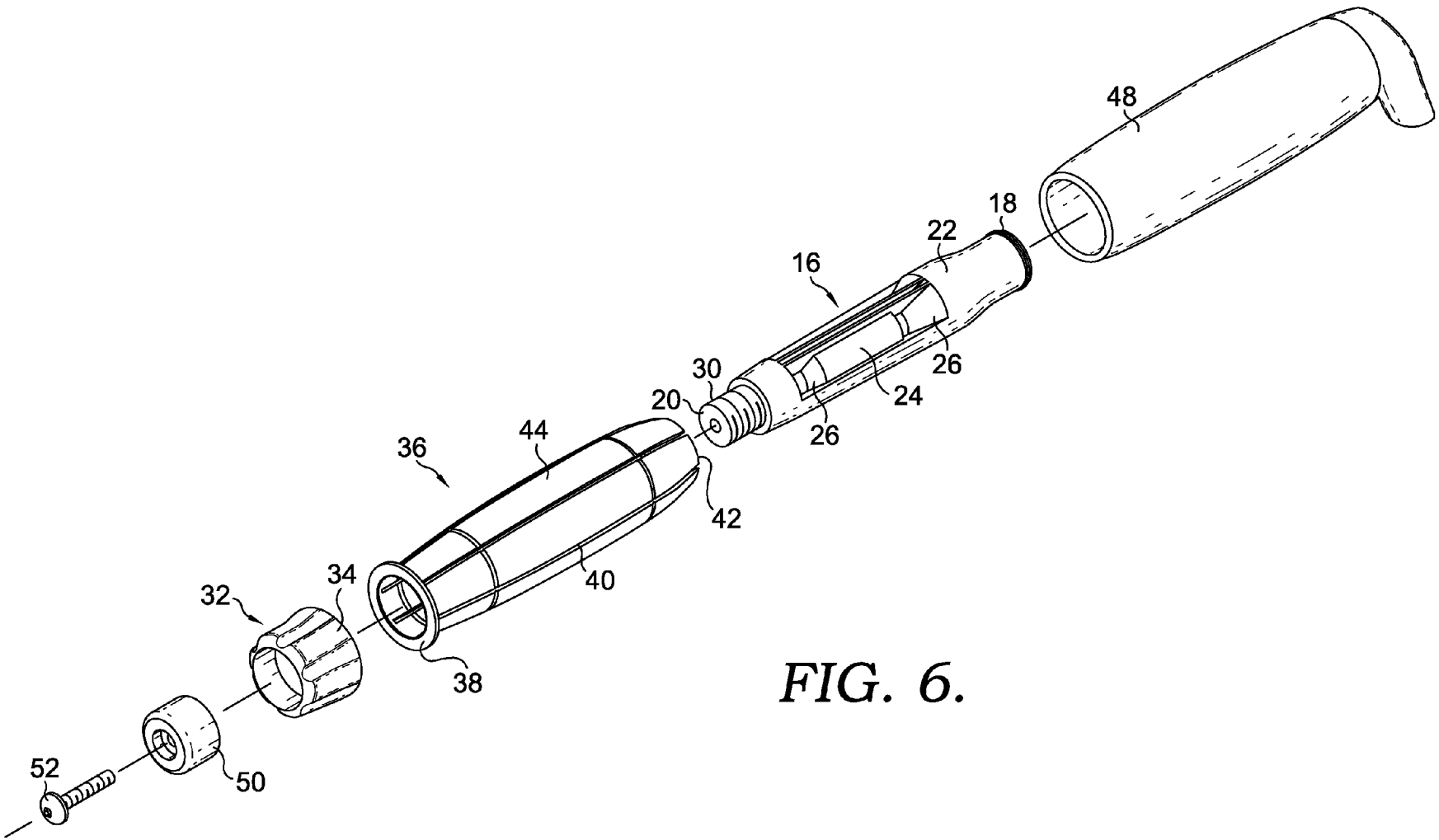
FIG. 6 is an exploded perspective view of a handle portion of a hand tool in accordance with an embodiment of the present invention.

At the opposite end of central core 16, or proximate second end 20, a portion of the outer surface 22 is threaded as depicted by identifier 30 and shown in FIG. 6. Although the central core 16 can be fabricated from a variety of materials, for the embodiment shown in FIGS. 3-7, the central core 16 is preferably fabricated from a plastic such as nylon 6/6, although other plastics with similar properties can be used.

Engaged with the threaded region of the central core is a knob 32 that can be turned by a user to adjust the handle geometry. The knob has an external surface 34 having a texture that improves the grip of the user. Examples of different grip configurations are shown in FIGS. 10-13. As with the central core, the knob 32 is also fabricated from a plastic material.

Positioned radially about the central core 16 is a sleeve 36 that has a first end 38 and a plurality of slots 40 extending axially to a sleeve second end 42, thereby forming a plurality of flexible expandable members 44. Located along the radial inner side of the plurality of flexible expandable members 44 are a plurality of fins 46. The fins 46 of the flexible expandable members 44 are positioned in a sliding relationship with the axially extending grooves 24 of the central core 16. The quantity of fins 46 in the plurality of flexible expandable members 44 corresponds to the quantity of radially extending ramps 26 in the plurality of axially extending grooves 24. The sleeve 36, as with the central core 16 and knob 32 is also fabricated from a plastic such as glass reinforced nylon 6/6. However, other plastics with similar properties can be used.

Positioned about the sleeve 36 and plurality of flexible expandable members 44 is a cover 48. The cover 48 is fabricated from a material that allows the user to have a secure grip on the handle 14 as well as permitting the handle 14 to expand and return to a contracted state. The preferred material for such an application is a vulcanized thermoplastic or thermoplastic elastomer with balanced polypropylene and rubber compounding to produce an acceptable hardness, stretch, and recovery memory. Another feature of the handle 14 is an end cap 50. The end cap 50 is coupled to the central core 16 by a removable fastener 52, such as a screw or bolt, and serves to limit the amount of travel by the knob 32, thereby preventing it from separating from the central core 16.

As previously discussed, the plurality of flexible expandable members 44 have fins 46 that are in slidable relationship with the axially extending grooves 24 of the central core 16. Furthermore, the knob 32 is in threaded engagement with the second end 20 of the central core 16. The axial position of the sleeve 36 and plurality of flexible expandable members 44 can be changed by turning the knob 32 and thereby moving it along the threaded portion of the second end 20 of the central core 16. This in turn causes the sleeve 36 to move in axially, and due to the ramps 26, in a radial direction. The knob 32 can be turned both clockwise and counterclockwise.

Figure 4:
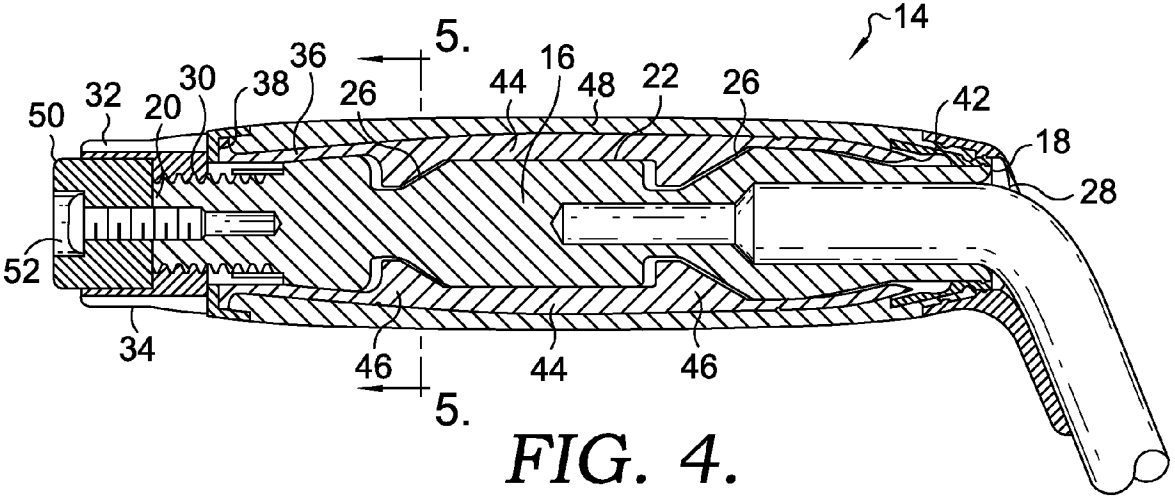
FIG. 4 is a cross section view of a handle portion of a hand tool in a contracted state in accordance with an embodiment of the present invention.
Figure 7:
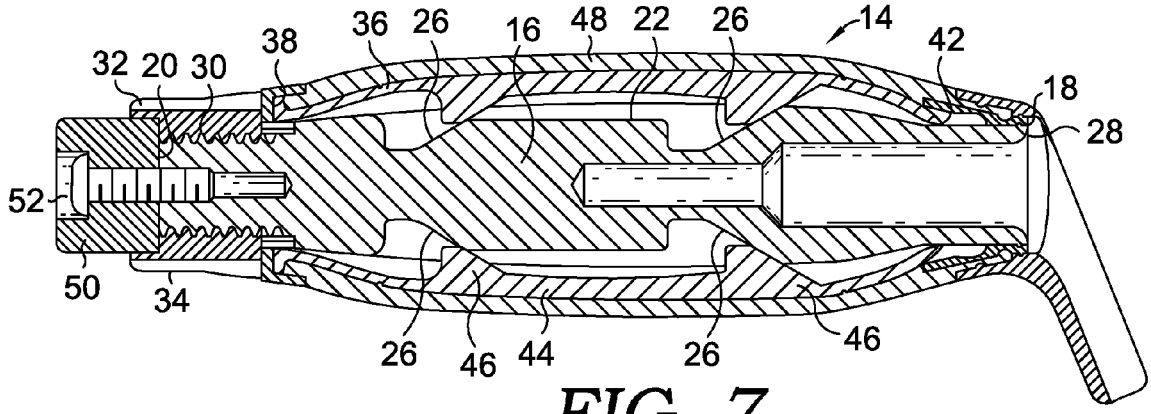
FIG. 7 is a cross section view of a handle portion of a hand tool with the handle in an expanded state in accordance with an embodiment of the present invention.
Figure 8:
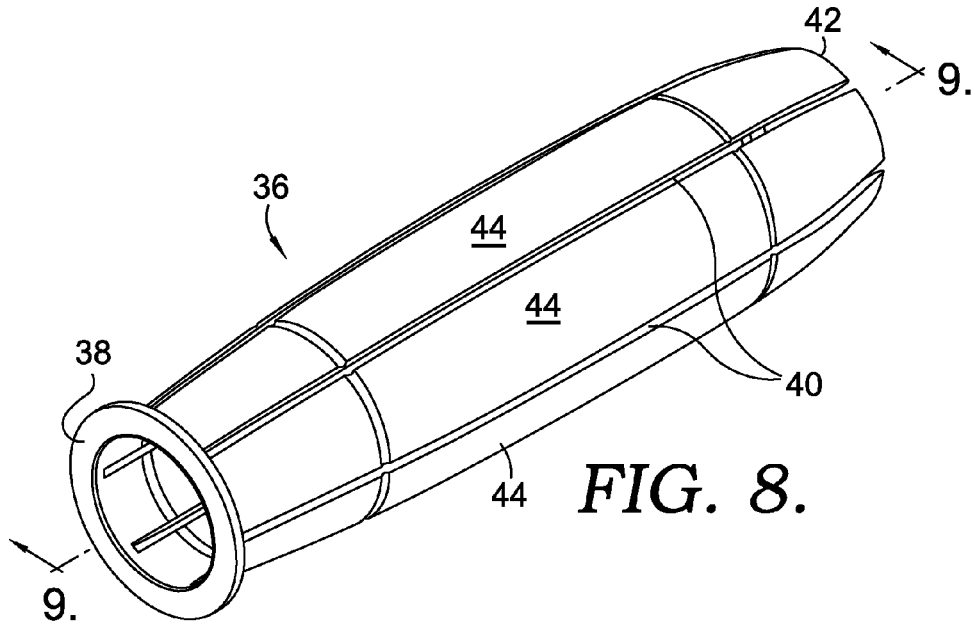
FIG. 8 is a perspective view of the sleeve and expandable members located about the central core of a handle portion of a hand tool in accordance with an embodiment of the present invention.
Figure 9:
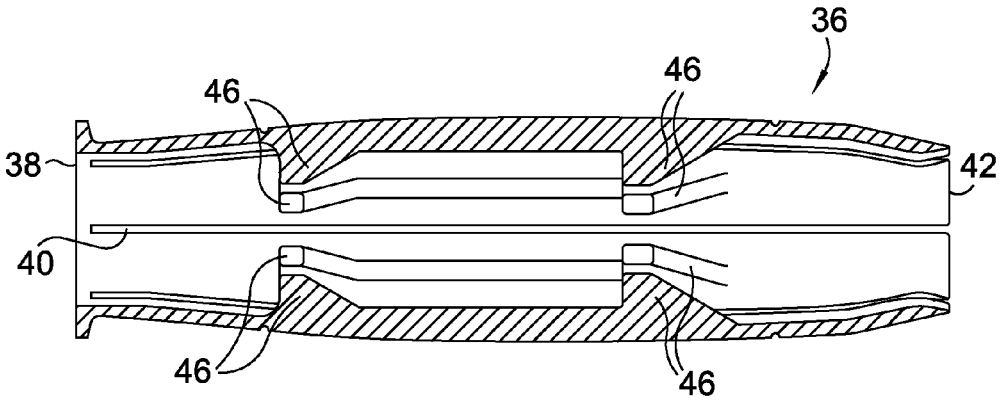
FIG. 9 is a cross section view of the sleeve and expandable members taken through FIG. 8 in accordance with an embodiment of the present invention.
Figure 10:
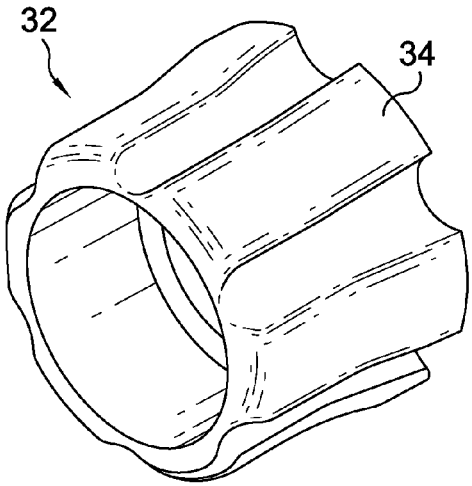
FIG. 10 is a perspective view of a knob for the end of a handle portion of a hand tool in accordance with an embodiment of the present invention.
Figure 11:
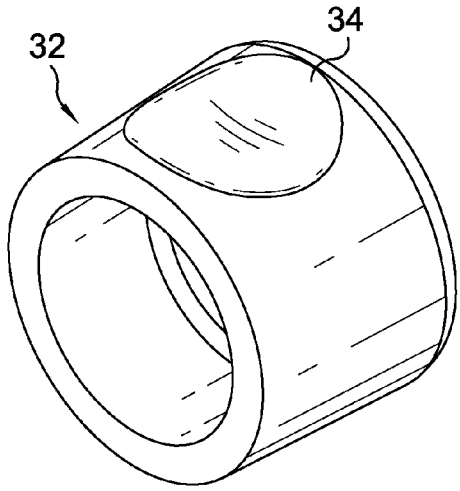
FIG. 11 is a perspective view of an alternate knob for the end of a handle portion of a hand tool in accordance with an embodiment of the present invention.
Figure 12:
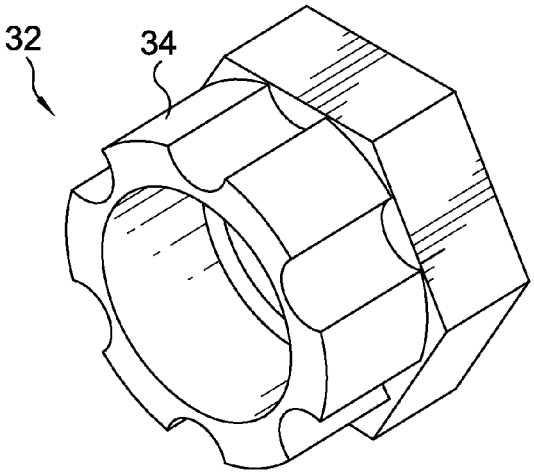
FIG. 12 a perspective view of another alternate knob for the end of a handle portion of a hand tool in accordance with an embodiment of the present invention.
Figure 13:
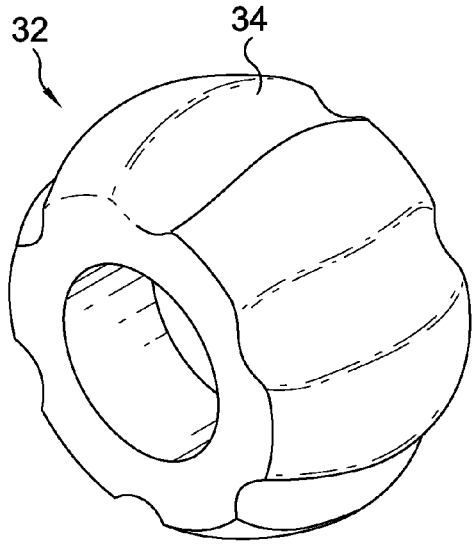
FIG. 13 is a perspective view of yet another alternate knob for the end of a handle portion of a hand tool in accordance with an embodiment of the present invention.

Adjusting the shape of the handle can be better understood with respect to FIG. 4 and FIG. 7. In order to adjust the handle shape, a user grips the cover 48 of the handle 14 with a user's first hand. Then, a user takes their second hand and turns the knob 32 either in a clockwise direction or a counterclockwise direction. As such, no external tooling is required to turn the knob. Referring initially to FIG. 4, it can be seen that the plurality of flexible expandable members 44 are initially in an axial position in which the fins 46 are located adjacent the plurality of ramps 26. If the user turns the knob 32 in a clockwise direction, the sleeve 36 and plurality of flexible expandable members 44 are moved axially away from the knob 32, thereby causing the fins 46 to contact the radially extending ramps 26 move radially outward along the radially extending ramps 26 so as to increase the size of the handle 14. This expanded handle geometry is shown in cross section in FIG. 7.

The exact change in shape and size of the handle 14 depends on a variety of factors including the quantity, angle, and axially spacing of the ramps 26 and the quantity and spacing of the axially extending grooves 24. For example, if the axially extending grooves 24 in which the fins 46 are positioned are substantially equally spaced about the handle 14, then the cross sectional shape of the handle 14 will change more uniformly than if the axially extending grooves 24 are unequally spaced. Therefore, for a generally round handle cross section, as shown in FIG. 5, the diameter will change more uniformly for generally equally spaced grooves 24. However, the present invention is not limited to a round handle cross section, nor to generally uniform change in cross section. In fact, the cross section of the handle 14 can be oblong, oval, or a variety of non-uniform shapes. Another factor affecting the change in handle geometry is the quantity of ramps 26, their axial spacing, and their respective angle. These factors determine the direction of cross-sectional geometry change and the axial length over which the change in handle geometry occurs. The ramps 26 in the embodiment disclosed herein are shown at 30 degrees relative to the horizontal. However, the ramp angles can be uniform or different so as to create a different cross sectional shape. For example, if the ramp angles alternate between 30 degrees and 45 degrees, a handle cross section can be changed from a circular shape to a square-like shape when it is expanded. The embodiment shown in FIGS. 4 and 7 comprise two sets of ramps spaced apart by an axial distance. However, the present invention is not limited to this embodiment in terms of ramp quantity or spacing and could include additional ramps 26 that are axially spaced either the same or differently.

In the event the user wants to contract the handle size, the user turns the knob 32 in a counterclockwise direction allowing the cover 48 to contract and causing the sleeve 36 and plurality of flexible expandable members 44 to move axially towards the knob 32, thereby causing the fins 46 to move radially inward along the radially extending ramps 26 so as to decrease the size of the handle 14. Through this movement, the handle changes geometry from that shown in FIG. 7 to that shown in FIG. 4. The process of turning the knob clockwise or counterclockwise can be repeated as required in order to adjust to handle to the user's satisfaction and comfort or to be adjusted to a different user of the tool.

An additional benefit of an adjustable handle that can be realized from this invention is the ability to adjust the handle size and shape for a user having a weakened hand condition or who has less hand strength then a typical user. By adjusting the handle geometry, the handle can better conform to the user's grip, even in a weakened state.

Although the handle configuration disclosed herein is depicted with respect to a hand tool, the adjustable handle can be utilized on other hand-held equipment and is not limited to hand tools. Other art fields that can utilize the present invention include, but are not limited to, sports equipment, cleaning equipment, and other devices that are grasped in a user's hand. Specific examples include golf clubs, tennis rackets, brooms, and mops, to name a few.

Many different arrangements of the various components depicted, as well as components not shown, are possible without departing from the spirit and scope of the present invention. Embodiments of the present invention have been described with the intent to be illustrative rather than restrictive. Alternative embodiments will become apparent to those skilled in the art that do not depart from its scope. A skilled artisan may develop alternative means of implementing the aforementioned improvements without departing from the scope of the present invention.

It will be understood that certain features and subcombinations are of utility and may be employed without reference to other features and subcombinations and are contemplated within the scope of the claims. Not all steps listed in the various figures need be carried out in the specific order described.

The invention claimed is:

1. An adjustable handle comprising:

a generally axially extending central core comprising a core first end, a core second end, and an outer surface having a plurality of axially extending grooves located therein, each of the axially extending grooves comprising a plurality of radially extending ramps, the ramps extending radially outward to the outer surface, the first end of the core having an opening for receiving a tool element, and the core having a threaded region along the outer surface proximate the second end;

a knob engaged with the threaded region of the central core;

a sleeve positioned about the central core and having a sleeve first end and a plurality of slots extending axially to a sleeve second end thereby forming a plurality of flexible expander members extending about the central core, each of the plurality of flexible expander members having a plurality of fins positioned in a sliding relationship with the axially extending grooves of the central core; and a cover positioned about the plurality of flexible expander members of the sleeve.

2. The adjustable handle of claim 1 wherein the central core, sleeve, and knob are plastic.

3. The adjustable handle of claim 1 wherein the plurality of axially extending grooves comprises at least three grooves.

4. The adjustable handle of claim 3 wherein the plurality of radially extending ramps comprises at least two ramps in each axially extending groove.

5. The adjustable handle of claim 1 wherein the plurality of fins in the plurality of flexible expandable members corresponds to the quantity of radially extending ramps in the plurality of axially extending grooves.

6. The adjustable handle of claim 1 wherein movement of the knob adjusts the axial position of the sleeve relative to the central core and thereby adjusts the axial and radial position of the plurality of flexible expander members.

7. The adjustable handle of claim 1 further comprising an end cap coupled to the central core by a removable fastener.

8. The adjustable handle of claim 1 wherein the cover is fabricated from an expandable and contractable material.

9. The adjustable handle of claim 1 wherein the knob has an external surface texture that improves grip by a user.

10. A tool handle capable of adjusting to a user's grip comprising:

a generally axially extending central core comprising a care first end, a core second end, and an outer surface having a plurality of axially extending grooves located therein, each of the axially extending grooves comprising a plurality of radially extending ramps, the ramps extending radially outward to the outer surface, the first end of the core having an opening for receiving a tool element, and the core having a threaded region along the outer surface proximate the second end;

a knob engaged with the threaded region of the central core;

a sleeve positioned about the central core and having a sleeve first end and a plurality of slots extending axially to a sleeve second end thereby forming a plurality of flexible expander members extending about the central core, each of the plurality of flexible expander members having a plurality of fins positioned in a sliding relationship with the axially extending grooves of the central core; and a cover positioned about the plurality of flexible expander members of the sleeve;

wherein a user can adjust a shape of the tool handle by turning the knob in a clockwise or counterclockwise direction so as to move the sleeve and plurality of flexible expander members axially such that the fins move along the radially extending ramps in a radial and axial direction.

11. The tool handle of claim 10 wherein the plurality of axially extending grooves comprises at least three grooves.

12. The tool handle of claim 11 wherein the plurality of radially extending ramps comprises at least two ramps in each axially extending groove.

13. The tool handle of claim 10 wherein the plurality of fins in the plurality of flexible expandable members corresponds to the quantity of radially extending ramps in the plurality of axially extending grooves.

14. The tool handle of claim 10 wherein turning the knob in the clockwise direction causes the sleeve to move axially in a direction away from the knob, thereby causing the fins of the plurality of flexible expandable members to move radially outward along the radially extending ramps in the plurality of axially extending grooves.

15. The tool handle of claim 10 wherein turning the knob in the counterclockwise direction causes the sleeve to move axially in a direction towards the knob, thereby causing the fins of the plurality of flexible expandable members to move radially inward along the radially extending ramps in the plurality of axially extending grooves allowing the cover to contract.

16. The adjustable handle of claim 10 wherein the knob has an external surface texture that eases grip by a user.

17. A method of adjusting a shape of a handle comprising:

providing a handle comprising a central core with a first end, a second end, and an outer surface having a plurality of axially extending grooves located therein, each of the axially extending grooves having a plurality of ramps extending radially outward towards the outer surface, the core having a threaded region along the outer surface proximate the second end, the handle having a knob in threaded engagement with the threaded region of the central core, a sleeve positioned about the central core and having a sleeve first end and a plurality of axially slots extending to a sleeve second end thereby forming a plurality of flexible expander members extending about the central core, each of the plurality of flexible expander members having a plurality of fins in a sliding relationship with the axially extending grooves of the central core and a cover positioned about the plurality of flexible expander members of the sleeve;

gripping the cover of the handle; and turning the knob in a clockwise or counterclockwise direction, thereby moving the sleeve and plurality of flexible expander members axially such that the fins move along the radially extending ramps of the central core to adjust the shape of the handle to the user's satisfaction and comfort.

18. The method of claim 17 wherein the turning of the knob in the clockwise direction causes the sleeve to move axially in a direction away from the knob, thereby causing the fins of the plurality of flexible expandable members to move radially outward along the radially extending ramps in the plurality of axially extending grooves to increase handle size.

19. The method of claim 17 wherein the tuning of the knob in the counterclockwise direction causes the sleeve to move axially in a direction towards the knob, thereby causing the fins of the plurality of flexible expandable members to move radially inward along the radially extending ramps in the plurality of axially extending grooves to decrease handle size.

20. The method of claim 17 wherein the plurality of fins in the plurality of flexible expandable members corresponds to the number of radially extending ramps in the plurality of axially extending grooves.

* * * * *